US006910687B1

(12) United States Patent
Van Nice et al.

(10) Patent No.: US 6,910,687 B1
(45) Date of Patent: Jun. 28, 2005

(54) SEPARATOR SHEET HANDLING ASSEMBLY

(75) Inventors: Jeff G. Van Nice, Beaver Dam, WI (US); Dennis A. VanderHoeven, Beaver Dam, WI (US); Brian E. Busse, Randolph, WI (US)

(73) Assignee: Arrowhead Systems LLC, Randolph, WI (US)

( * ) Notice: Subject to any disclaimer, the term of this patent is extended or adjusted under 35 U.S.C. 154(b) by 209 days.

(21) Appl. No.: 10/030,853

(22) PCT Filed: Jul. 13, 2000

(86) PCT No.: PCT/US00/19090

§ 371 (c)(1),
(2), (4) Date: Jan. 11, 2002

(87) PCT Pub. No.: WO01/04025

PCT Pub. Date: Jan. 18, 2001

Related U.S. Application Data

(60) Provisional application No. 60/143,575, filed on Jul. 13, 1999, and provisional application No. 60/149,002, filed on Aug. 13, 1999.

(51) Int. Cl.[7] ..... B65H 3/14
(52) U.S. Cl. ..... 271/98; 209/549
(58) Field of Search ..... 271/98; 209/599, 209/603; B65H 3/14

(56) References Cited

U.S. PATENT DOCUMENTS

| | | | |
|---|---|---|---|
| 3,717,249 | A | 2/1973 | Faley |
| 3,812,964 | A | 5/1974 | Woodruff |
| 4,180,258 | A | 12/1979 | Wildforster |
| 4,211,398 | A | 7/1980 | Bishop |
| 4,245,830 | A | 1/1981 | Fichte et al. |
| 4,765,606 | A | 8/1988 | Marass |
| 4,768,913 | A | 9/1988 | Baba |
| 5,115,144 | A | 5/1992 | Koniski et al. |
| 5,979,891 | A | 11/1999 | Roux |
| 6,082,732 | A | 7/2000 | Hutchison et al. |

*Primary Examiner*—Donald P. Walsh
*Assistant Examiner*—Kenneth W. Bower
(74) *Attorney, Agent, or Firm*—Michael Best & Friedrich LLP

(57) ABSTRACT

The present invention is embodied in a separator sheet handling assembly (10) that includes a lifting assembly (20) adapted to receive a pallet (12) containing a stack of separator sheets (14). The lifting assembly (20) positions the stack of separator sheets (14) into a predetermined location where a feed assembly (30) engages a separator sheet (16) positioned at the top of the stack of separator sheets (14). The feed assembly (30) removes the separator sheet (16) and transports it to a test assembly (50) where the separator sheet (16) is monitored for a particular characteristic such as cleanlines or structural integrity. The separator sheet (16) is delivered to a first storage assembly (60) if the separator sheet (16) has the particular characteristic, or a second storage assembly (70) if the separator sheet (16) does not include the particular characteristic.

70 Claims, 6 Drawing Sheets

SEPARATOR SHEET HANDLING ASSEMBLY

This application is a 371 of PCT/US00/19090 filed Jul. 13, 2000, which claims benefit of 60/143,575 filed Jul. 13, 1999, and claims benefit for Ser. No. 60/149,002 filed Aug. 13, 1999.

FIELD OF THE INVENTION

The invention relates generally to an assembly for handling separator sheets, and particularly to an assembly that sorts a pile of separator sheets, which are used in stacking multiple layers of products onto pallets, into different piles depending on the characteristics of the individual separator sheets.

BACKGROUND OF THE INVENTION

Smaller products or articles of production (e.g., beverage containers) are commonly stacked on to pallets for shipping and handling. The products are arranged in horizontal tiers, or layers, on the pallet such that additional layers can be stacked on top of the lower layers. Separator sheets are placed between the layers of products to provide a uniform support surface for each layer of products. The uniform support surface makes adding and removing the top layer of products easier. As the top layers of products are unstacked from the pallet, the separator sheets between each layer are removed and set aside for reuse.

Depending on the types of products that are stacked onto the pallet, and the environment where the stacking process takes place, the separator sheets may become dirty and/or damaged. Using a dirty or damaged separator sheet in order to facilitate stacking products into layers on a pallet can result in (i) the products becoming damaged or dirty, (ii) the products being stacked on to the pallet unsafely, and (iii) damage to the palletizing machine that stacks the products on to the pallet.

SUMMARY OF THE INVENTION

The present invention provides a separator sheet handling assembly that is capable of (i) receiving a stack of separator sheets, (ii) testing the separator sheets, and (iii) sorting the separator sheets into various piles depending on whether each separator sheet is dirty, clean, damaged or undamaged (among other characteristics).

The separator sheet handling assembly includes a lifting assembly that is adapted to receive a pallet containing a stack of separator sheets. The lifting assembly positions the stack of separator sheets into a predetermined location where a feed assembly engages a separator sheet positioned at the top of the stack of separator sheets. The feed assembly delivers the top separator sheet to a test assembly where the separator sheet is monitored for a particular characteristic (e.g., cleanliness or structural integrity). The separator sheet is delivered to a first storage assembly if the separator sheet has a particular characteristic, or a second storage assembly if the separator sheet does not include a particular characteristic.

Other features and advantages of the invention will become apparent to those skilled in the art upon review of the following detailed description, claims and drawings.

Figure 2:
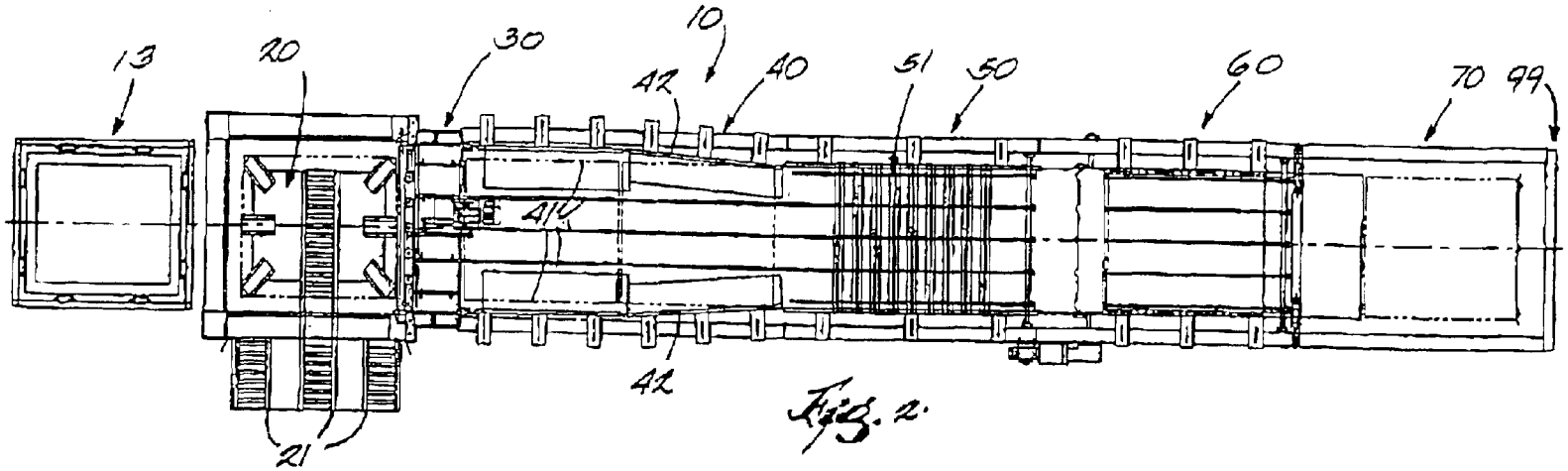
FIG. 2 is a top elevation view of the separator sheet handling assembly shown in FIG. 1.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION

Figure 1:
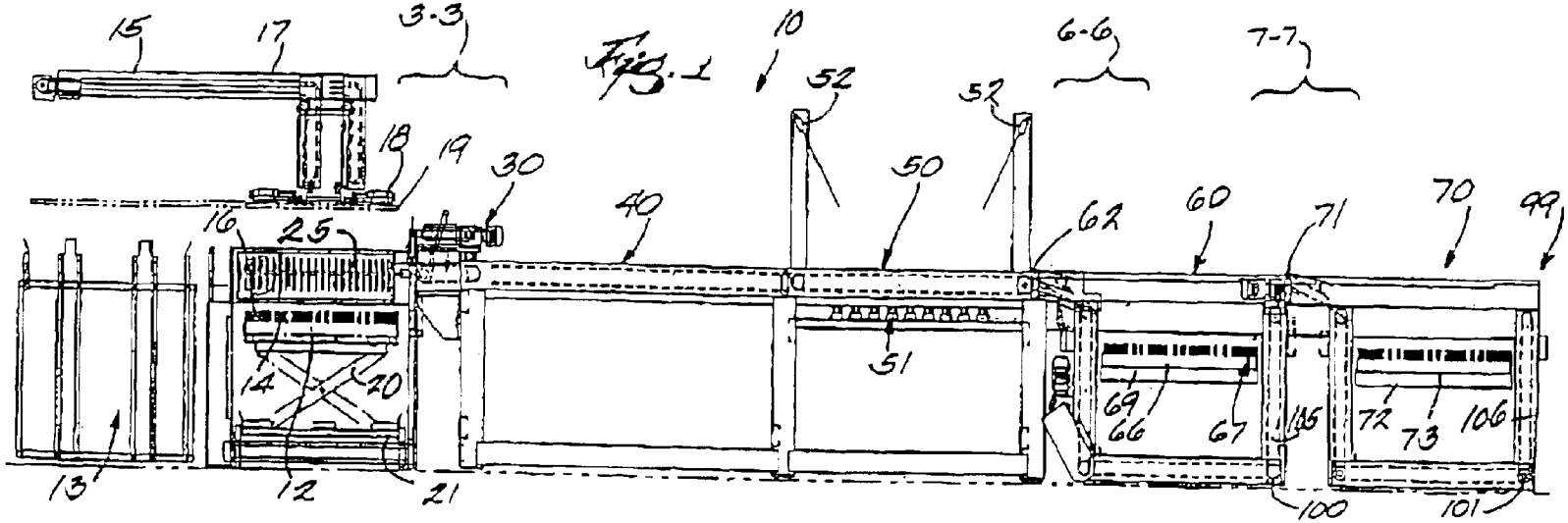
FIG. 1 is a side view of a separator sheet handling assembly embodying the present invention.

A separator sheet handling assembly 10 embodying the invention is illustrated in FIGS. 1 and 2. The illustrated separator sheet handling assembly 10 includes a lift assembly 20, feed assembly 30, alignment assembly 40, test assembly 50, first storage assembly 60 and second storage assembly 70.

During operation of the separator sheet handling assembly 10, a pallet 12 having a stack of separator sheets 14 thereon is supplied into the lift assembly 20. The lift assembly 20 moves the pallet 12 upward until the feed assembly 30 grasps a separator sheet 16 positioned on lop of the stack of separator sheets 14. The feed assembly 30 transports the separator sheet 16 into the alignment assembly 40. As the separator sheet 16 passes through the alignment assembly 40, the separator sheet 16 is maneuvered to a predetermined location for delivery to the test assembly 50. The test assembly 50 is adapted to test the separator sheet 16 in order to determine if the separator sheet 16 is clean and free from holes, tears or any other damage. The separator sheet 16 is preferably tested (and analyzed) as it is transported through the test assembly 50, although the movement of the separator sheet 16 might have to either be slowed, or stopped altogether, depending on types of tests that are performed.

Depending on the condition of the separator sheet 16, it is either transported into the first storage assembly 60 or transported over the first storage assembly 60 into the second storage assembly 70. It should be noted that additional storage assemblies could be added if the test assembly 50 has the capacity to analyze additional characteristics on the separator sheet 16. As an example, clean and undamaged separator sheets 16 would be transported to the first storage assembly 60, dirty but undamaged sheets would be transported into the second storage assembly 70 and damaged sheets would be transported into a third storage assembly (not shown).

In the assembly illustrated in FIGS. 1 and 2, the lift assembly 20 is adapted to receive a pallet 12 that is inserted by a lift truck or other pallet handling device including, but not limited to, a conveyor 21. Although any conventional lift could be employed without departing from the scope of present invention, the lift assembly 20 is shown as a scissors lift which is powered by a hydraulic cylinder that indexes the pallet 12 upward at designated intervals so that the feed assembly 30 removes the separator sheets 16 one at a time from the top of the stack of separator sheets 14.

Positioned above the lift assembly 20 is a top frame remover assembly 17 (shown in FIG. 1 only). The top frame remover assembly 17 includes a gripper assembly 18 (shown in the raised position) that is lowered as needed to grab a top frame 19 positioned on top of the stack of separator sheets 14. The gripper assembly 18 is suspended from, and travels along, horizontal rails 15. During operation of the separator sheet handling assembly 10, the gripper assembly 18 is positioned above the lift assembly 20 until a top frame 19 is detected on top of the stack of separator sheets 14. Operation of the sheet feed assembly 30 is suspended and the gripper assembly 18 lowers until it engages the top frame 19 and grabs it with pneumatically powered grippers (not shown). The gripper assembly 18 then returns to the raised position and moves along guide rails 15 until it is over a frame collection bin 13 where the top frame 19 is released by the grippers to fall into the frame collection bin 13. As shown in FIG. 2, the top frame collection bin 13 is positioned beside lift assembly 20 but it should be understood that it can be positioned in any available position that is adjacent to the lift assembly 20.

The lift assembly 20 also includes an air chamber 25 positioned near the top of the stack of separator sheets 14. The air chamber 25 moves air through the lift assembly 20 to facilitate removing only the top separator sheet 16 instead of multiple sheets. The sheets in the stack of separator sheets 14 often tend to adhere to the top sheet due to moisture, dirt and/or static among other reasons.

In a preferred form of the invention, the lift assembly 20 includes squaring fences (not shown). The squaring fences organize the stack of separator sheets 14 into a neat pile before the uppermost sheet is removed by the feed assembly 30. The squaring fences can be any configuration commonly known in the art and may continuously, or periodically, square the stack of separator sheets 14 as the lift assembly 20 indexes the pallet upward toward the feed assembly 30.

Figure 3:
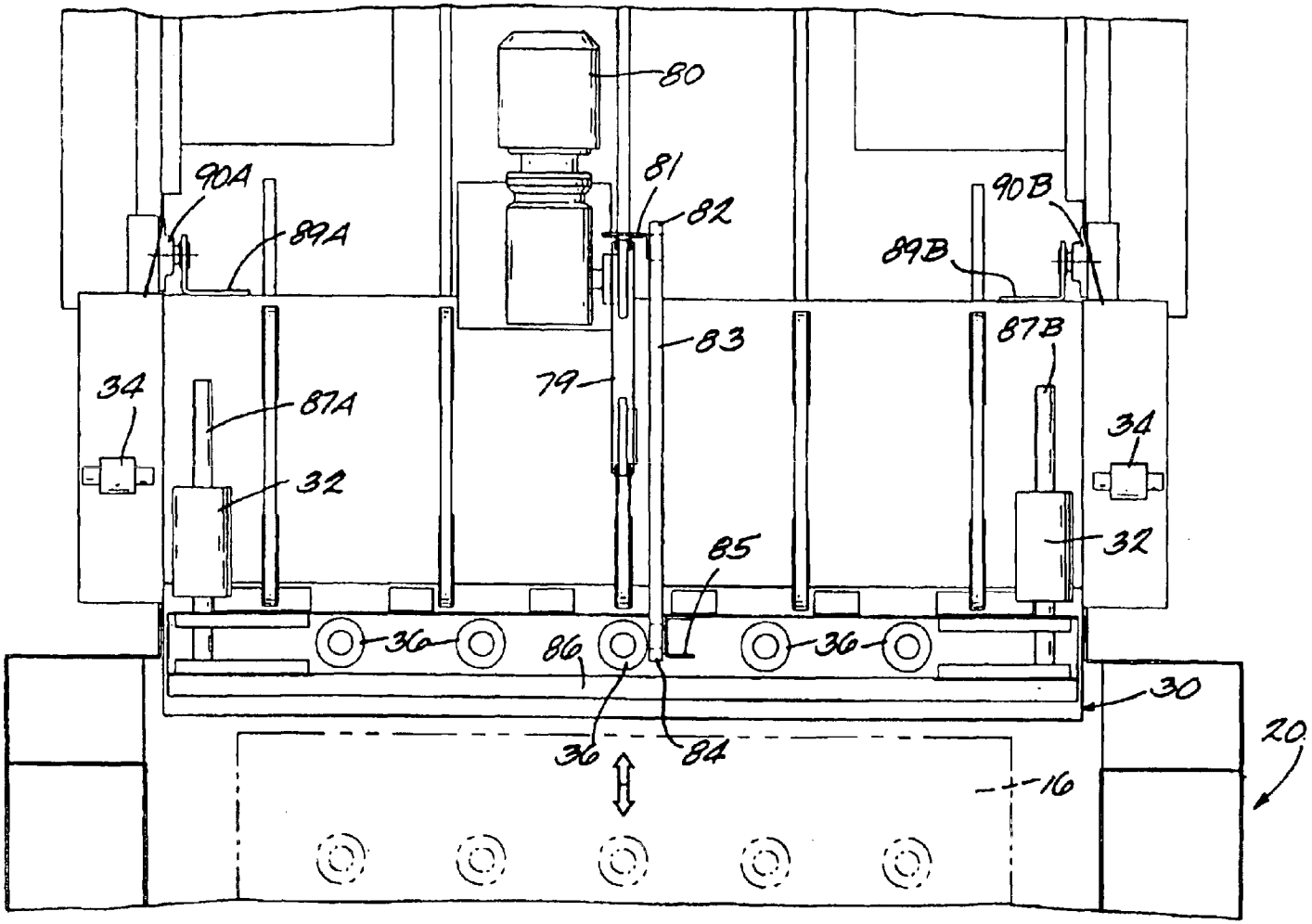
FIG. 3 is an enlarged top elevation view taken in the area 3—3 of the separator sheet handling system shown in FIG. 1.
Figure 4:
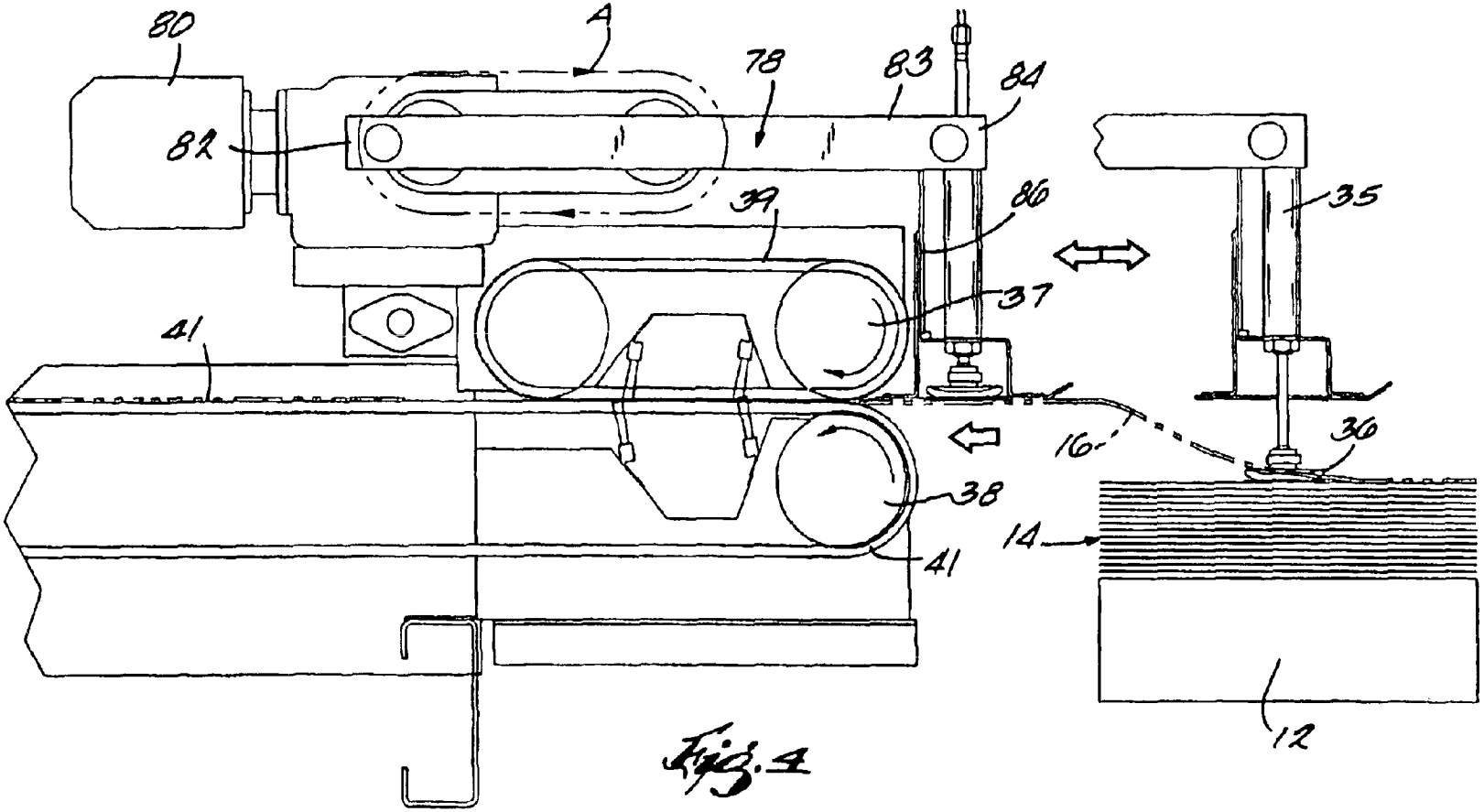
FIG. 4 is a side view of the portion of the sheet handler assembly shown in FIG. 3.
Figure 5:
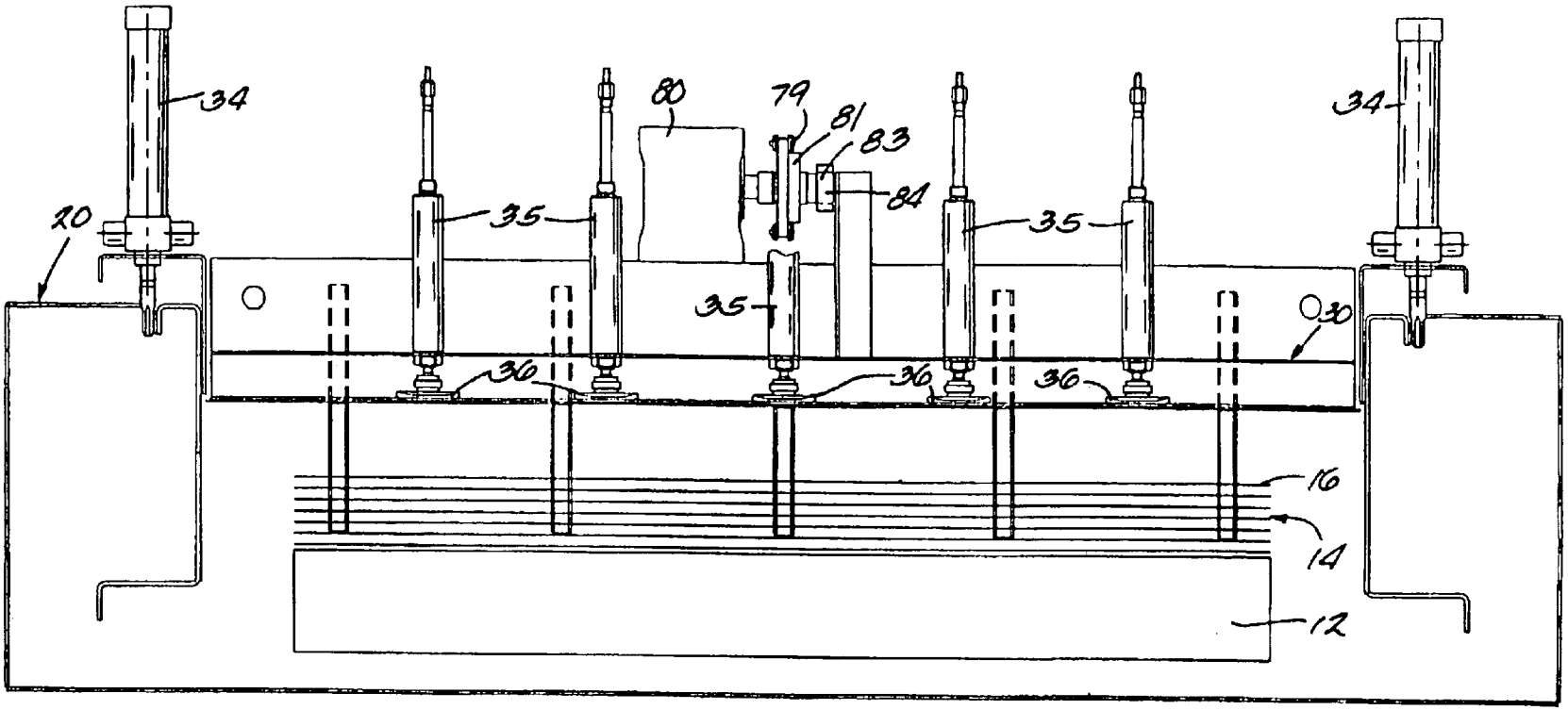
FIG. 5 is a rear view of the portion of the sheet handler assembly shown in FIG. 3.

The feed assembly 30 is shown in detail in FIGS. 3–5. The feed assembly 30 is adapted for horizontal movement relative to the lift assembly 20 and the alignment assembly 40. Horizontal motion is translated to a portion 78 of the feed assembly 30 by a drive 80. The drive 80 maneuvers a chain 79 in an endless pattern as indicated by arrow A in FIG. 4. A bracket 81 is connected to a section of the chain 79 such that the bracket 81 moves along the path of the chain 79. The bracket 81 is pivotally connected to one end 82 of a support arm 83 such that maneuvering the bracket 81 causes movement of the support arm 83. An opposite end 84 of the support arm 83 is pivotally connected to a bracket 85 (see FIG. 3) that is connected to a laterally extending support structure 86 of the feed assembly 30. The pivotal connection between the ends 82, 84 of the support arm 83 and the respective brackets 81, 85 causes the nonlinear motion of the support arm 83 to be translated to horizontal linear motion of the laterally extending support structure 86. A pair of support rods 87A, 87B extend longitudinally from opposite sides of the laterally extending support structure 86. The support rods 87A, 87B are supported for horizontal movement by bearings 32 positioned on opposite sides of the separator sheet handling assembly 10. The feed assembly 30 is maneuvered vertically by pneumatic cylinders 34 positioned on opposite sides of the separator sheet handling assembly 10.

The feed assembly 30 includes vacuum fittings 36 that engage the top surface of the separator sheet 16. A preferred form and arrangement of the vacuum fittings 36 are disclosed in PCT/US97/07520, which is incorporated herein by reference.

During operation of the separator sheet handling assembly 10, the feed assembly 30 moves backward and downward to grasp the separator sheet 16 positioned on the top of the stack of separator sheets 14. Once the vacuum fittings 36 engage the top surface of the separator sheet 16, the feed assembly 30 moves upward and forward to position the separator sheet 16 between rotating drive rollers 37, 38. Drive roller 38 drives a first plurality of endless belts 41 and drive roller 37 drives a second plurality of endless belts 39. The first and second plurality of belts 39, 41 contact the upper and lower surface of the separator sheet 16 and deliver the separator sheet 16 into the alignment assembly 40.

The feed assembly 30 includes a pair of brackets 89A, 89B that are pivotally connected to support members 90A, 90B that are part of separator sheet handling assembly 10. This pivoted connected allows the feed assembly 30 to be rotated (i.e., raised up) by activating pneumatic cylinders 34 that are positioned on opposite sides of the feed assembly 30. The ability to raise the feed assembly 30 in this manner permits easy inspection and/or maintenance of the area between the first and second plurality of belts 39, 41, especially when a separator sheet 16 becomes jammed in the feed assembly 30.

The separator sheet 16 is carried through the alignment assembly 40 by the first plurality of belts 41 which are positioned across the width of the separator sheet handling assembly 10. As the separator sheet 16 travels through the alignment assembly 40, the separator sheet 16 is maneuvered by guides 42 into a predetermined position. The separator sheet 16 needs to be maneuvered into this predetermined position so that the separator sheet 16 is properly positioned as it enters the test assembly 50.

The plurality of belts 41 also transports the separator sheet 16 through the test assembly 50. The test assembly 50 uses conventional monitoring devices in order to collect data regarding certain characteristics of each separator sheet 16. In a preferred form, the test assembly 50 includes a light emitting system 51 that projects light upward toward the separator sheet 16 as the separator sheet 16 passes through the test assembly 40. The test assembly 50 further includes a sensor 52 that checks to see if any light passes through the separator sheet due to tears or holes in the separator sheet 16. The test assembly 50 could also perform other tests on the separator sheet 16 that are commonly known in the art, including, but not limited to, checking for load tags and surface contamination (e.g., oil or syrup spots, and footprints).

The collected data is supplied to a computer (not shown) or some other decisionmaking entity. The computer then instructs the separator sheet handling assembly 10 to direct the separator sheet 16 into either the first storage assembly 60 or the second storage assembly 70.

Figure 6:
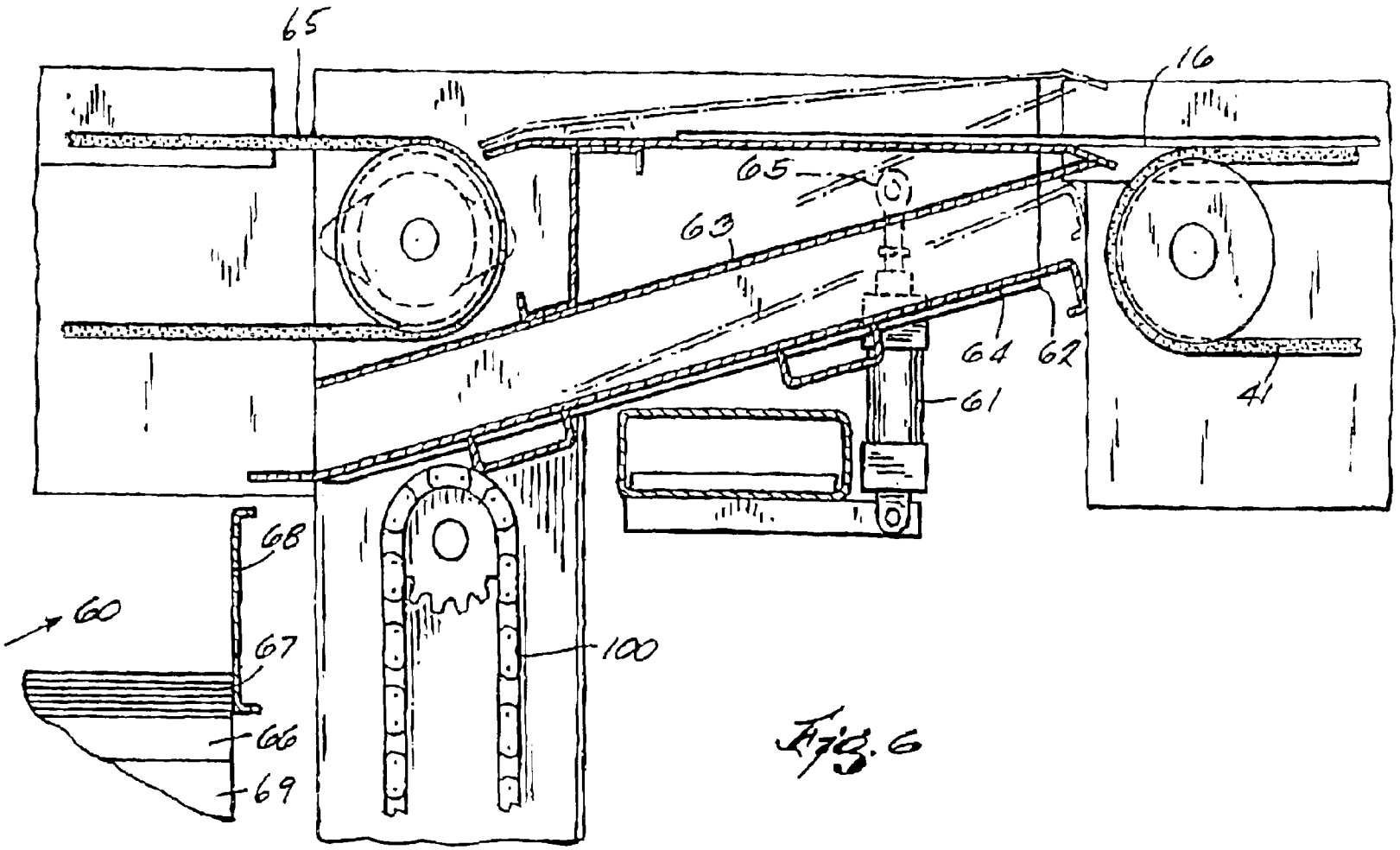
FIG. 6 is an enlarged side view of the separator sheet handling assembly of FIG.1 taken from the area 6—6 in FIG. 1.
Figure 7:
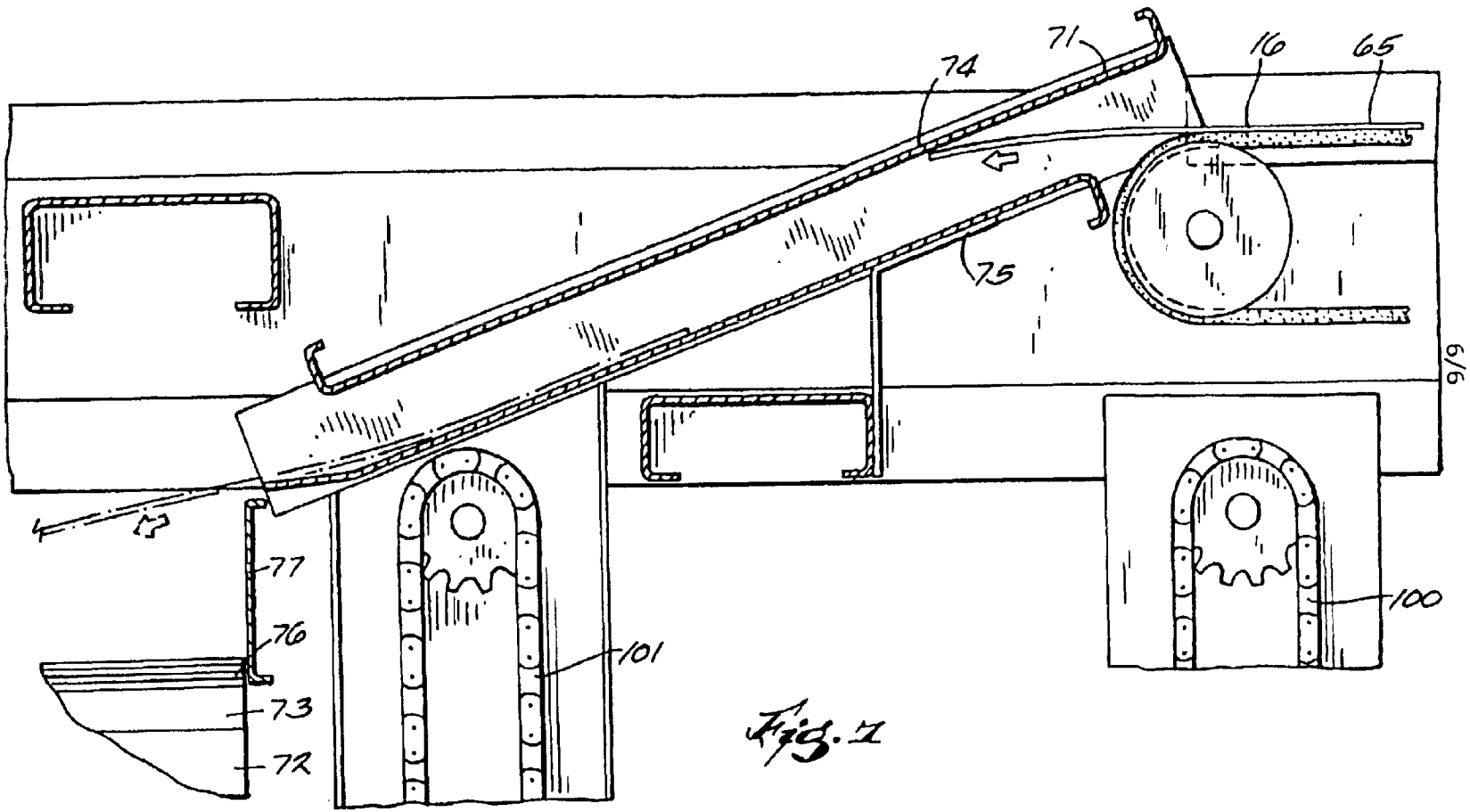
FIG. 7 is an enlarged side view of the separator sheet handling assembly of FIG. 1 taken from the area 7—7 in FIG. 1.

The delivery of the separator sheet 16 into either the first storage assembly 60 or the second storage assembly 70 is illustrated in FIGS. 6 and 7. Depending on the characteristics of the separator sheet 16, the computer sends out a signal that directs an actuator 61 to either expand or contract. The actuator 61 is connected to a directing guide 62 that moves up and down as the actuator 61 expands and contracts. In the assembly illustrated in FIG. 6, the actuator 61 is contracted such that the directing guide 62 is in a lowered position.

When the directing guide 62 is in the lowered position, the separator sheet 16 passes over the directing guide 62 and moves from the plurality of laterally spaced belts 41 onto a separate set of laterally spaced belts 65 that transport the separator sheet 16 to the second storage assembly 70.

If the computer directs the actuator 61 to expand, the directing guide 62 moves into a raised position (see phantom lines in FIG. 6) such that the separator sheet 16 enters the directing guide 62 between an upper bracket 63 and a lower bracket 64. The separator sheet 16 continues through the directing guide 62 into the first storage assembly 60.

The first storage assembly 60 includes a lifting frame 69 that is capable of supporting a pallet 66 in a predetermined location. The separator sheet 16 enters the first storage assembly 60 and is positioned on top of a pile 67 of previously sorted separator sheets by guides 68. The lifting frame 69 is maneuvered up and down using chains 100 that are driven by sprockets positioned on opposite sides of a support structure 105. As the separator sheets 16 continue to stack up on the pallet 66, the lifting frame 69 is indexed downwardly until a desired number of separator sheets 16 have been stacked on to the pallet 66. The full pallet 66 may be directed from the first storage assembly 60 via a conveyor (not shown).

The situation illustrated in FIG. 7 occurs when the actuator 61 is retracted and the separator sheet 16 is transported over the directing guide 62 onto the plurality of laterally spaced belts 65. The plurality of belts 65 transport the separator sheet 16 between an upper bracket 74 and a lower bracket 75 on a receiving guide 71. The separator sheet 16 passes through the receiving guide 71 and is directed onto a pile of separator sheets 76 by guides 77. The second storage assembly 70 includes a lifting frame 72 that is adapted to support a pallet 73. Chains 101 move the lifting frame 72 up and down. Sprockets positioned on opposite sides of a support structure 106 support the chains 101. The lifting frame 72 indexes downwardly as the separator sheets 16 are stacked onto the pallet 73. Once the pallet 73 is stacked full of separator sheets, the pallet 73 can either be removed directly or transported via a conveyor (not shown) to another location.

The receiving guide 71 is different from the directing guide 62 in that the receiving guide 71 is not adjustable. As stated previously, the separate sheet handling assembly 10 can include additional storage assemblies (not shown). It should be apparent that the separator sheets need to be directed into one of the storage assemblies. The separator sheets will be directed into the storage assembly located on the end of the separator sheet handling assembly 10 if the separator sheet 16 has not been previously directed into another storage assembly. Therefore, a nonadjustable receiving guide 71 should be located before the final storage assembly.

In one form of the invention, the storage assemblies 60, 70 each include squaring fences (not shown). The squaring fences organize the stack of separator sheets 14 into a neat pile as the sheets 16 are inserted into the respective storage assemblies 60, 70. The squaring fences can be any configuration commonly known in the art and may continuously or periodically square the stacks of separator sheets as the respective lifting frames 69, 72 index the pallets 66, 73 downward.

In another embodiment of present invention the second storage assembly 70 does not include a lifting frame 72. Instead, the second storage assembly is located adjacent to the frame of separator sheet handling assembly 10 such that sheets 16 which are not delivered to the first storage assembly 60 are delivered off of an end 99 of the separator sheet handling assembly 20 into a receptacle (e.g., a trash bin).

Various features of the invention are set forth in the following claims.

What is claimed is:

1. A separator sheet handling assembly for sorting a stack of separator sheets into different locations depending on their characteristics, said separator sheet handling assembly comprising:

a lifting assembly adapted to receive a pallet having the stack of separator sheets piled thereon;

a feed assembly adapted to consecutively engage a separator sheet positioned at the top of the stack of separator sheets;

a test assembly for monitoring the separator sheets received from the feed assembly wherein the test assembly monitors the structural integrity of the separator sheets;

a first storage assembly for receiving designated separator sheets; and a second storage assembly for receiving the remaining separator sheets.

2. The separator sheet handling assembly of claim 1 further comprising an alignment assembly that aligns the separator sheets received from the feed assembly into a predetermined position for delivery into the test assembly.

3. The separator sheet handling assembly of claim 2, wherein the alignment assembly includes vertical guides positioned on at least one side of the sheet handling assembly such that the guides laterally maneuver each separator sheet before the separator sheet enters the test assembly.

4. The separator sheet handling assembly of claim 1 further comprising at least one additional storage assembly for receiving some of the separator sheets from the test assembly.

5. The separator sheet handling assembly of claim 1, wherein the lifting assembly includes a lifting frame for indexing the pallet containing the stack of separator sheets upward to a position where the feed assembly removes the separator sheet positioned on the top of the stack of separator sheets.

6. The separator sheet handling assembly of claim 5, wherein the lifting assembly includes a support structure and a drive system mounted to the support structure, said drive system being adapted to index the lifting frame upward at designated intervals.

7. The separator sheet handling assembly of claim 5, wherein the lifting assembly includes squaring fences positioned around the stack of separator sheets to square the separator sheets before they are delivered through the feed assembly.

8. The separator sheet handling assembly of claim 1, wherein the lifting assembly includes an air chamber positioned near the top of the stack of separator sheets for moving air through the lift assembly to facilitate removing only the top separator sheet instead of multiple sheets.

9. The separator sheet handling assembly of claim 1, wherein the feed assembly includes a first drive roller.

10. The separator sheet handling assembly of claim 9 wherein the feed assembly includes a second drive roller and the first drive roller drives a first plurality of endless belts and the second drive roller drives a second plurality of endless belts such that the separator sheets are fed between the first and second plurality of belts.

11. The separator sheet handling assembly of claim 10, wherein the feed assembly moves to engage the separator sheet positioned on the top of the stack of separator sheets and positions the separator sheet between first and second surfaces of the first and second plurality of belts.

12. The separator sheet handling assembly of claim 1, wherein a portion of the feed assembly is pivotally connected to a support structure on the separator sheet handling assembly.

13. The separator sheet assembly of claim 12, wherein the portion of the feed assembly is movable relative to the support structure.

14. The separator sheet handling assembly of claim 1, wherein the feed assembly includes at least one vacuum fitting for engaging the separator sheet positioned on the top of the stack of separator sheets.

15. The separator sheet handling assembly of claim 14, wherein the feed assembly includes a positioning drive for moving the vacuum fittings relative to the lift assembly.

16. The separator sheet handling assembly of claim 15, wherein the positioning drive moves the vacuum fittings horizontally relative to the lift assembly.

17. The separator sheet handling assembly of claim 16, wherein the feed assembly includes at least one air cylinder for vertically adjusting the vacuum fittings relative to lift assembly.

18. The separator sheet handling assembly of claim 15, wherein the positioning drive is connected to a chain that moves in an endless pattern, a portion of the chain being connected to a first bracket such that the first bracket moves along the path of the chain, the first bracket being pivotally connected to one end of a support arm such that the maneuvering of the first bracket by the positioning drive causes movement of the support arm, an opposite end of the support arm being pivotally connected to a second bracket that is connected to a support structure that secures the vacuum fittings such that the pivotal connection between the opposing ends of the support arm and the first and second brackets causes nonlinear motion of the chain to be translated to linear motion of the vacuum fittings.

19. The separator sheet handling assembly of claim 1, wherein the second storage assembly that receives the remaining separator sheets is a receptacle positioned adjacent to a frame of the separator sheet handling assembly such that the receptacle receives sheets which are delivered off an end of the frame.

20. The separator sheet handling assembly of claim 1, wherein the test assembly monitors the cleanliness of the separator sheets.

21. A separator sheet handling assembly for sorting a stack of separator sheets into different locations depending on their characteristics, said separator sheet handling assembly comprising:

a lifting assembly adapted to receive a pallet having the stack of separator sheets piled thereon;

a feed assembly adapted to consecutively engage a separator sheet positioned at the top of the stack of separator sheets;

a test assembly for monitoring the separator sheets received from the feed assembly;

a first storage assembly for receiving designated separator sheets, the first storage assembly including a directing guide maneuverable between a first position that allows the separator sheet to bypass the directing guide and a second position where the separator sheet enters the directing guide; and a second storage assembly for receiving the remaining separator sheets.

22. The separator sheet handling assembly of claim 21, wherein the directing guide includes an upper bracket and a lower bracket and the separator sheet enters the directing guide between the lower bracket and the upper bracket when the directing guide is in the second position.

23. The separator sheet handling assembly of claim 21, wherein the first storage assembly includes a lifting frame that is adapted to receive the separator sheets passing through the directing guide.

24. The separator sheet handling assembly of claim 21, wherein the first storage assembly includes a support structure and a drive system mounted on the support structure, the drive system indexing the lifting frame downward as the separator sheets are delivered onto a pallet positioned on the lifting frame.

25. The separator sheet handling assembly of claim 21, wherein the second storage assembly includes a receiving guide positioned to accept the separator sheets that do not enter the first storage assembly.

26. The separator sheet handling assembly of claim 21, further comprising at least one additional storage assembly for receiving some of the separator sheets from the test assembly.

27. The separator sheet handling assembly of claim 21, wherein the second storage assembly that receives the remaining separator sheets is a receptacle positioned adjacent to a frame of the separator sheet handling assembly such that the receptacle receives sheets which are delivered off an end of the frame.

28. The separator sheet handling assembly of claim 21, wherein the first storage assembly includes squaring fences positioned around the stack of separator sheets to square the separator sheets after they are delivered to the first storage assembly.

29. A separator sheet handling assembly for sorting a stack of separator sheets into different locations depending on their characteristics, said separator sheet handling assembly comprising:

a lifting assembly adapted to receive a pallet having the stack of separator sheets piled thereon;

a feed assembly adapted to consecutively engage a separator sheet positioned at the top of the stack of separator sheets;

a test assembly for monitoring the separator sheets received from the feed assembly;

a first storage assembly for receiving designated separator sheets; and a second storage assembly for receiving the remaining separator sheets wherein the second storage assembly includes a receiving guide positioned to accept the separator sheets that do not enter the first storage assembly.

30. The separator sheet handling assembly of claim 29, wherein the receiving guide includes an upper bracket and a lower bracket and the separator sheet enters the receiving guide between the lower bracket and the upper bracket.

31. The separator sheet handling assembly of claim 29, wherein the second storage assembly includes a lifting frame that is adapted to receive the separator sheets passing through the receiving guide.

32. The separator sheet handling assembly of claim 31, wherein the second storage assembly includes a support structure and drive system mounted on the support structure, the drive system indexing the lifting frame downward as the separator sheets are delivered onto a pallet positioned on the lifting frame.

33. The separator sheet handling assembly of claim 29 further comprising at least one additional storage assembly for receiving some of the separator sheets from the test assembly.

34. The separator sheet handling assembly of claim 29, wherein the second storage assembly that receives the remaining separator sheets is a receptacle positioned adjacent to a frame of the separator sheet handling assembly such that the receptacle receives sheets which are delivered off an end of the frame.

35. A separator sheet handling assembly for sorting a stack of separator sheets into different locations depending on their characteristics, said separator sheet handling assembly comprising:

a lifting assembly adapted to receive a pallet having the stack of separator sheets piled thereon;

a top frame remover assembly for removing a top frame positioned on top of the stack of separator sheets;

a feed assembly adapted to consecutively engage a separator sheet positioned at the top of the stack of separator sheets;

a test assembly for monitoring the separator sheets received from the feed assembly;

a first storage assembly for receiving designated separator sheets; and a second storage assembly for receiving the remaining separator sheets.

36. The separator sheet handling assembly of claim 35, wherein the top frame remover assembly includes a pair of guided horizontal rails and a gripper assembly that grasps the top frame, the gripper assembly moves along the pair of guided horizontal rails until the gripper assembly is positioned above a collection bin where the gripper assembly releases the top frame allowing the top frame to fall into the collection bin.

37. The separator sheet handling assembly of claim 35, wherein the lifting assembly includes a lifting frame for indexing the pallet containing the stack of separator sheets upward to a position where the feed assembly removes the separator sheet positioned on the top of the stack of separator sheets.

38. The separator sheet handling assembly of claim 35, wherein the feed assembly includes a first drive roller.

39. The separator sheet handling assembly of claim 38 wherein the feed assembly includes a second drive roller and the first drive roller drives a first plurality of endless belts and the second drive roller drives a second plurality of endless belts such that the separator sheets are fed between the first and second plurality of belts.

40. The separator sheet handling assembly of claim 39, wherein the feed assembly moves to engage the separator sheet positioned on the top of the stack of separator sheets and positions the separator sheet between first and second surfaces of the first and second plurality of belts.

41. The separator sheet handling assembly of claim 35, wherein a portion of the feed assembly is pivotally connected to a support structure on the separator sheet handling assembly.

42. The separator sheet assembly of claim 41, wherein the portion of the feed assembly is movable relative to the support structure.

43. The separator sheet handling assembly of claim 35, wherein the feed assembly includes at least one vacuum fitting for engaging the separator sheet positioned on the top of the stack of separator sheets.

44. The separator sheet handling assembly of claim 43, wherein the feed assembly includes a positioning drive for moving the vacuum fittings relative to the lift assembly.

45. The separator sheet handling assembly of claim 44, wherein the positioning drive moves the vacuum fittings horizontally relative to the lift assembly.

46. The separator sheet handling assembly of claim 45, wherein the feed assembly includes at least one air cylinder for vertically adjusting the vacuum fittings relative to lift assembly.

47. The separator sheet handling assembly of claim 44, wherein the positioning drive is connected to a chain that moves in an endless pattern, a portion of the chain being connected to a first bracket such that the first bracket moves along the path of the chain, the first bracket being pivotally connected to one end of a support arm such that the maneuvering of the first bracket by the positioning drive causes movement of the support arm, an opposite end of the support arm being pivotally connected to a second bracket that is connected to a support structure that secures the vacuum fittings such that the pivotal connection between the opposing ends of the support arm and the first and second brackets causes nonlinear motion of the chain to be translated to linear motion of the vacuum fittings.

48. The separator sheet handling assembly of claim 35, wherein the test assembly monitors the cleanliness of the separator sheets.

49. A separator sheet handling assembly for sorting a stack of separator sheets into different locations depending on their characteristics, said separator sheet handling assembly comprising:

a lifting assembly adapted to receive a pallet having the stack of separator sheets piled thereon;

a feed assembly adapted to consecutively engage a separator sheet positioned at the top of the stack of separator sheets;

a test assembly for monitoring the separator sheets received from the feed assembly;

a first storage assembly for receiving designated separator sheets, the first storage assembly including squaring fences positioned around the stack of separator sheets to square the separator sheets after they are delivered to the first storage assembly; and a second storage assembly for receiving the remaining separator sheets.

50. The separator sheet handling assembly of claim 49 further comprising at least one additional storage assembly for receiving some of the separator sheets from the test assembly.

51. The separator sheet handling assembly of claim 49, wherein the second storage assembly that receives the remaining separator sheets is a receptacle positioned adjacent to a frame of the separator sheet handling assembly such that the receptacle receives sheets that are delivered off an end of the frame.

52. The separator sheet handling assembly of claim 49, wherein the test assembly monitors the cleanliness of the separator sheets.

53. The separator sheet handling assembly of claim 49, wherein the test assembly monitors the structural integrity of the separator sheets.

54. The separator sheet handling assembly of claim 49, wherein the first storage assembly includes a directing guide that is maneuverable between a first position that allows the separator sheet to bypass the directing guide and a second position where the separator sheet enters the directing guide.

55. The separator sheet handling assembly of claim 54, wherein the feed sub-assembly includes a lifting frame for indexing a pallet containing a stack of separator sheets upwardly to a position where the feed sub-assembly removes one individual separator sheet from the top of the stack of separator sheets.

56. The separator sheet handling assembly of claim 54, wherein the feed sub-assembly includes a first drive roller that rotates to feed the individual separator sheets from the feed sub-assembly toward the test sub-assembly.

57. The separator sheet handling assembly of claim 56, wherein at least a portion of the feed sub-assembly moves to engage an individual separator sheet positioned on the top of a stack of separator sheets, and moves to engage the individual separator sheet with the first drive roller.

58. The separator sheet handling assembly of claim 54, wherein the feed sub-assembly includes at least one vacuum fitting for engaging an individual separator sheet positioned on the top of a stack of separator sheets.

59. The separator sheet handling assembly of claim 54, wherein the characteristic monitored by the test sub-assembly is cleanliness of the separator sheets.

60. The separator sheet handling assembly of claim 54, wherein the plurality of paths includes a first path that includes a first storage sub-assembly, and a second path that includes a second storage sub-assembly.

61. The separator sheet handling assembly of claim 49, wherein the second storage assembly includes a receiving guide positioned to accept the separator sheets that do not enter the first storage assembly.

62. A separator sheet handling assembly for conveying individual separator sheets from a common location toward one of multiple different locations depending on at least one characteristic of the individual separator sheet, the separator sheet handling assembly comprising:

a feed sub-assembly for feeding individual separator sheets;

a test sub-assembly for monitoring the characteristic of the individual separator sheets wherein the characteristic monitored by the test sub-assembly is structural integrity of the separator sheets; and a delivery sub-assembly for guiding the individual separator sheets along a selected one of a plurality of paths, the one path being selected in response to the monitored characteristic of the individual separator sheet.

63. A separator sheet handling assembly for conveying individual separator sheets from a common location toward one of multiple different locations depending on at least one characteristic of the individual separator sheet, the separator sheet handling assembly comprising:

a feed sub-assembly for feeding individual separator sheets;

a test sub-assembly for monitoring the characteristic of the individual separator sheets;

a delivery sub-assembly for guiding the individual separator sheets along a selected one of a plurality of paths, the one path being selected in response to the monitored characteristic of the individual separator sheet; and a path selector communicating with the test subassembly and the delivery sub-assembly, the path selector receiving information regarding the characteristic from the test sub-assembly and selecting the one of the plurality of paths in response to the information.

64. The separator sheet handling assembly of claim 63, wherein the feed sub-assembly includes a lifting frame for indexing a pallet containing a stack of separator sheets upwardly to a position where the feed sub-assembly removes one individual separator sheet from the top of the stack of separator sheets.

65. The separator sheet handling assembly of claim 63, wherein the feed sub-assembly includes a first drive roller that rotates to feed the individual separator sheets from the feed sub-assembly toward the test sub-assembly.

66. The separator sheet handling assembly of claim 65, wherein at least a portion of the feed sub-assembly moves to engage an individual separator sheet positioned on the top of a stack of separator sheets, and moves to engage the individual separator sheet with the first drive roller.

67. The separator sheet handling assembly of claim 63, wherein the feed sub-assembly includes at least one vacuum fitting for engaging an individual separator sheet positioned on the top of a stack of separator sheets.

68. The separator sheet handling assembly of claim 63, wherein the characteristic monitored by the test sub-assembly is cleanliness of the separator sheets.

69. The separator sheet handling assembly of claim 63, wherein the characteristic monitored by the test sub-assembly is structural integrity of the separator sheets.

70. The separator sheet handling assembly of claim 63, wherein the plurality of paths includes a first path that includes a first storage sub-assembly, and a second path that includes a second storage sub-assembly.

* * * * *